US010783845B2

(12) United States Patent
Ono et al.

(10) Patent No.: US 10,783,845 B2
(45) **Date of Patent: *Sep. 22, 2020**

(54) LIQUID CRYSTAL CONTROL CIRCUIT, ELECTRONIC TIMEPIECE, AND LIQUID CRYSTAL CONTROL METHOD

(71) Applicant: CASIO COMPUTER CO., LTD., Shibuya-ku, Tokyo (JP)

(72) Inventors: Takahiro Ono, Akishima (JP); Fumiaki Ochiai, Higashiyamato (JP); Yoshinori Asami, Fussa (JP); Eiji Yamakawa, Tama (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/357,979

(22) Filed: Mar. 19, 2019

(65) Prior Publication Data

US 2019/0295485 A1 Sep. 26, 2019

(30) Foreign Application Priority Data

Mar. 22, 2018 (JP) ..... 2018-054626

(51) Int. Cl.
*G09G 3/36* (2006.01)
*G04G 9/12* (2006.01)

(52) U.S. Cl.
CPC ..... *G09G 3/3614* (2013.01); *G04G 9/12* (2013.01); *G09G 2310/08* (2013.01)

(58) Field of Classification Search
CPC ..... G04G 9/0005; G04G 9/0094; G04G 9/06; G04G 9/12; G04G 2310/08; G09G 3/3614
See application file for complete search history.

(56) References Cited

U.S. PATENT DOCUMENTS

2006/0145985 A1* 7/2006 Hwang ..... G09G 3/3655 345/92
2012/0306835 A1 12/2012 Kitagawa et al.
2017/0153661 A1* 6/2017 Kamiyama ..... G06F 1/12

FOREIGN PATENT DOCUMENTS

JP 5450784 B2 3/2014

* cited by examiner

*Primary Examiner* — Shaheda A Abdin
(74) *Attorney, Agent, or Firm* — Seed IP Law Group LLP

(57) ABSTRACT

A liquid crystal control circuit is provided for driving a MIP liquid crystal panel. The MIP liquid crystal panel has a plurality of pixels, each of which includes a memory element and a display element. The memory element holds electric potential depending on an image signal. The display element is applied voltage depending on the electric potential which the memory element holds. The liquid crystal control circuit includes an inversion unit that inverts polarity of AC voltage in a first mode in which an enable signal is output. The AC voltage being is applied to the display element in synchronization with outputting of the enable signal. The enable signal activates the image signal output to the MIP liquid crystal panel.

12 Claims, 6 Drawing Sheets

LIQUID CRYSTAL CONTROL CIRCUIT, ELECTRONIC TIMEPIECE, AND LIQUID CRYSTAL CONTROL METHOD

CROSS-REFERENCE TO RELATED APPLICATION

This application is based on and claims priority under 35 USC 119 from Japanese Patent Application No. 2018-054626 filed on Mar. 22, 2018, the contents of which are incorporated herein by reference.

TECHNICAL FIELD

The technical field relates to a liquid crystal control circuit, an electronic timepiece, and a liquid crystal control method.

BACKGROUND

Recently, mobile devices represented by mobile phones have been dramatically developed, and a demand for higher performance and higher functionality of displays for mobile devices has increased. As performance required for displays, there are lager area, higher resolution, smaller thickness and less weight, narrower frame, lower power consumption, higher luminance, wider view angle, faster responsibility, and so on.

Also, since a lot of mobile devices are driven by batteries, the available time of each device is determined by the power consumption of the system and the capacity of the battery. For this reason, it is essential to reduce the power consumption of each system, and it is very strongly required to reduce the power consumption of each of devices to be installed in such mobile devices. For this purpose, MIP (Memory-in-Pixel) liquid crystal panels are suitable. In Japanese Patent No. 5450784, an invention related to control on an MIP liquid crystal display is disclosed.

In general liquid crystal displays, even in the case of still images such as standby images for mobile devices, in order to keep displaying such a still image, current should be continuously applied. In contrast, in MIP liquid crystal displays, since pixels constituting a screen have memories, if a still image is displayed, it is possible to keep displaying the still image, without applying current.

As compared to electronic paper displays competing as display elements, MIP liquid crystal displays consume less power during data updating, and can perform image rewriting more quickly, and are superior in visibility in bright environments and dark environments. Electronic paper displays need to perform screen refreshing in order to rewrite screens. For this reason, they cannot display videos. However, MIP liquid crystal displays can display videos.

Also, as compared to organic EL (Electro-Luminescence) displays competing as display elements, MIP liquid crystal displays are superior in power consumption and visibility in bright environments. In organic EL displays, a predetermined current is applied to each self-luminous display element. However, in MIP liquid crystal displays, when displaying a still image is kept, current is not applied to each display element.

In MIP liquid crystal displays, the timings when a COM inversion signal is applied to each display element in order to maintain the reliability of each display are not synchronized with the timings of image data signals. In such MIP liquid crystal displays, if the output timings of them overlap, image writing may not be normally performed. For this reason, timing control for avoiding competition between the COM inversion signal and image data signals is required.

According to the invention disclosed in Japanese Patent No. 5450784, it is possible to avoid competition between the COM inversion signal and image data signals. However, according to the invention of Japanese Patent No. 5450784, image data signals are transmitted at timings different from the timings when they should be transmitted under ordinary circumstances. Therefore, the quality of video display is damaged.

SUMMARY

A liquid crystal control circuit related to preferred embodiments is provided for driving a MIP (Memory In Pixel) liquid crystal panel. The MIP liquid crystal panel has a plurality of pixels, each of which includes a memory element and a display element. The memory element holds electric potential depending on an image signal. The display element is applied voltage depending on the electric potential which the memory element holds. The liquid crystal control circuit includes an inversion unit that inverts polarity of AC voltage in a first mode in which an enable signal is output. The AC voltage being is applied to the display element in synchronization with outputting of the enable signal. The enable signal activates the image signal output to the MIP liquid crystal panel.

DETAILED DESCRIPTION OF THE PREFERRED EMBODIMENTS

Hereinafter, an embodiment will be described in detail with reference to the drawings.

In a liquid crystal panel in which the timings of a COM inversion signal (VCOM) for maintaining the reliability of the liquid crystal panel and the timings of image data signals are not synchronized, like MIP liquid crystal panels, control for avoiding competition for timing between the VCOM and image data signals is performed.

Figure 1:
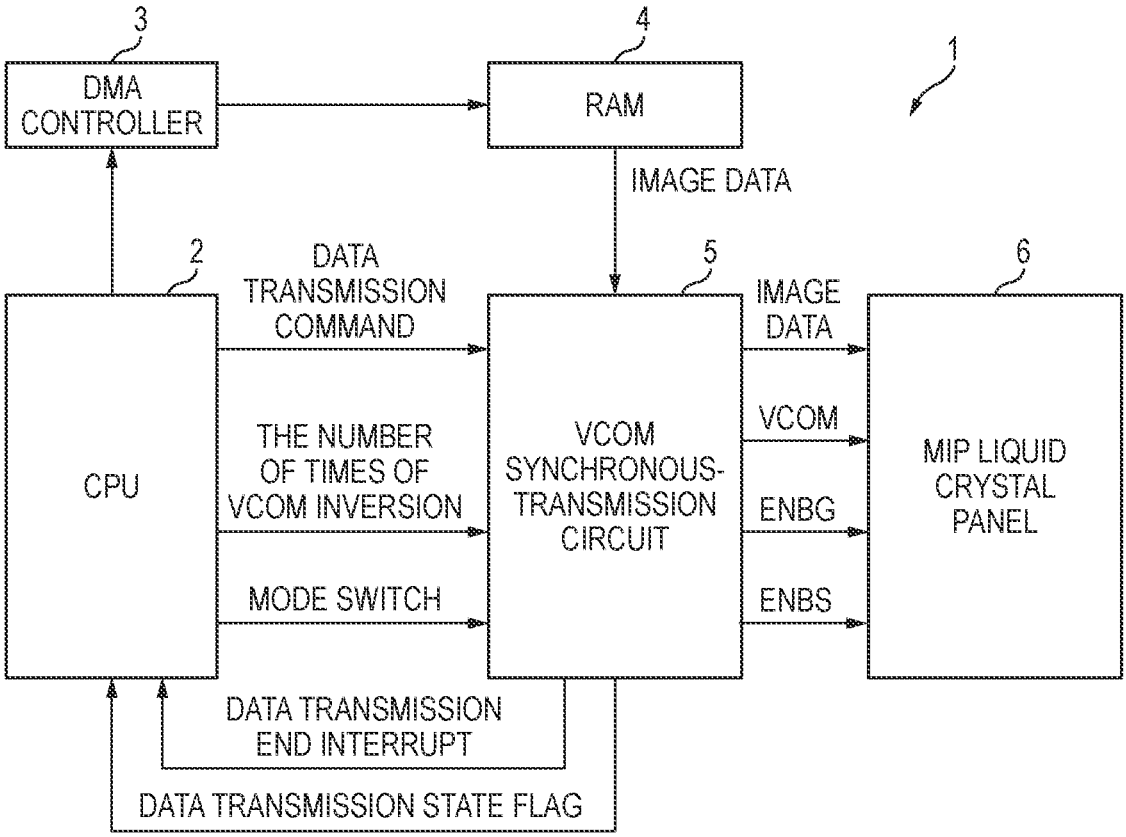
FIG. 1 is a view illustrating a rough configuration of an electronic timepiece including a VCOM synchronous-transmission circuit according to an embodiment.

FIG. 1 is a view illustrating a rough configuration of an electronic timepiece 1 including a VCOM synchronous-transmission circuit 5 according to the present embodiment.

The electronic timepiece 1 includes a CPU (Central Processing Unit) 2, a DMA (Direct Memory Access) controller 3, and a RAM (Random Access Memory) 4. The electronic timepiece 1 also includes the VCOM synchronous-transmission circuit 5 and an MIP liquid crystal panel 6. The electronic timepiece 1 is for measuring time and displaying the time.

The CPU 2 is for controlling the whole of the electronic timepiece 1, and is connected to the DMA controller 3 and the VCOM synchronous-transmission circuit 5, and directly controls them. The CPU 2 sets a mode switch signal and the number of times of VCOM inversion for the VCOM synchronous-transmission circuit 5, and outputs data transmission commands. Here, the CPU 2 selects such an optimum value that VCOM inversion is performed less and does not influence the reliability of the MIP liquid crystal panel, and sets the selected value as the number of times of VCOM inversion.

The DMA controller 3 is a dedicated circuit for transmitting image data from the RAM 4 (to be described below) to the MIP liquid crystal panel 6 via the VCOM synchronous-transmission circuit 5. The DMA controller is used to output image data to the VCOM synchronous-transmission circuit 5 after the CPU 2 outputs a data transmission command to the VCOM synchronous-transmission circuit 5. However, the DMA controller 3 may be configured with a dedicated circuit for outputting data, not as a general-purpose DMA controller.

The RAM 4 is a volatile semiconductor memory device, and is for storing image data to be displayed on the MIP liquid crystal panel 6.

The VCOM synchronous-transmission circuit 5 is a liquid crystal control circuit configured to drive and control the MIP liquid crystal panel 6 by outputting image data, the VCOM, and enable signals to the MIP liquid crystal panel. Image data is information on images to be displayed on the MIP liquid crystal panel 6. The VCOM is a VCOM inversion signal designating the polarity of AC voltage in order to maintain the reliability of the MIP liquid crystal panel 6. The enable signals are ENBS and ENBG shown in FIG. 1, and are for activating (enabling) image data in the MIP liquid crystal panel 6.

The VCOM synchronous-transmission circuit 5 determines an operation mode according to the mode switch signal set by the CPU 2. Also, the VCOM synchronous-transmission circuit 5 transmits image data corresponding to the designated number of times at the interval from an inversion of the VCOM to the next inversion.

The MIP liquid crystal panel 6 has a plurality of pixels, each of which has a memory element which holds electric potential according to an image signal, and a display element to which voltage according to the electric potential which the memory element holds is applied. In the MIP liquid crystal panel 6, each pixel has a built-in 1-bit static RAM as the memory element for holding electric potential according to an image signal.

If gate bus lines are selected, the MIP liquid crystal panel 6 stores data of data bus lines in the static RAMs. According to the data stored in the static RAMs, a display voltage supply circuit (not shown in the drawings) supplies voltage to the pixel electrodes of the display elements. Then, each display element performs display according to the voltage applied between the counter electrode and the pixel electrode.

In the case of rewriting display data, peripheral circuits are operated, and the data of the static RAMs in the individual pixels is updated. In the case where still image display is performed and display rewriting is not required, electric potential is always supplied to the pixel electrodes by the display voltage supply circuit, so any variation does not occur in the electric potential of each pixel electrode. Therefore, the VCOM inversion interval of the MIP liquid crystal panel 6 can be set to a frequency of 1 Hz. As a result, the MIP liquid crystal panel 6 can significantly reduce the power consumption.

Figure 2:
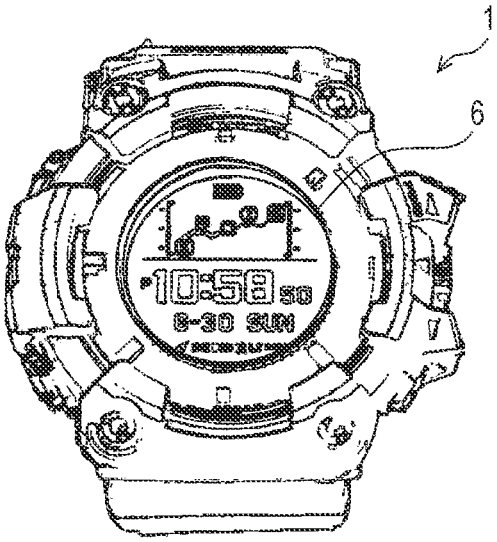
FIG. 2 is a view illustrating the external appearance of the electronic timepiece.

FIG. 2 is a view illustrating the external appearance of the electronic timepiece 1.

The electronic timepiece 1 is a digital watch, and displays the time in numbers on the MIP liquid crystal panel 6. Since the electronic timepiece 1 is required to be driven with a very small battery for a long period, it is very important to reduce the power consumption.

Figure 3:
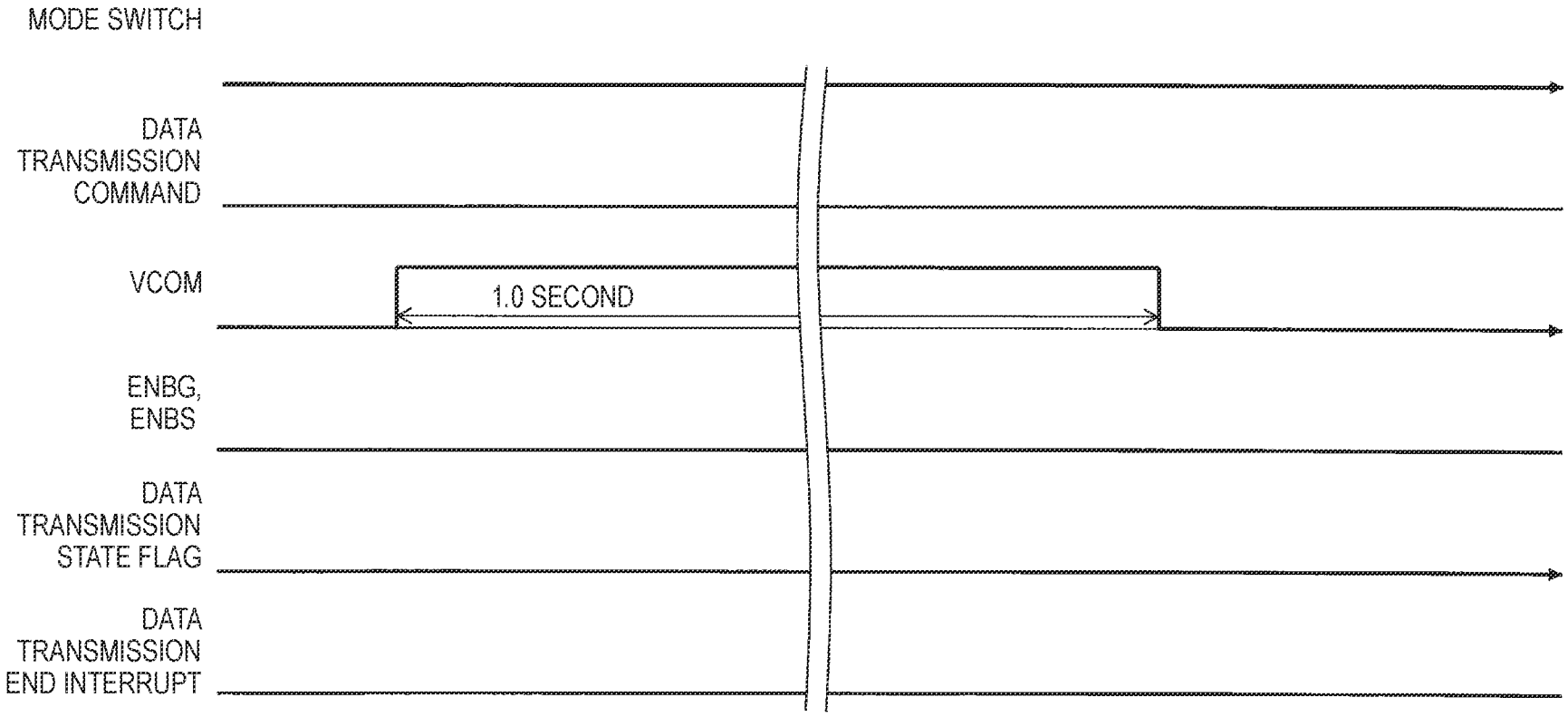
FIG. 3 is a time chart in a periodic VCOM inversion mode.

FIG. 3 is a time chart in the periodic VCOM inversion mode.

In the periodic VCOM inversion mode (a second mode), the mode switch signal is set at the L level. In the periodic VCOM inversion mode, the VCOM is inverted at a predetermined interval. The polarity of the VCOM of the present embodiment is inverted every second.

In the periodic VCOM inversion mode, there is no data transmission command. Therefore, the enable signal is not output, and a data transmission state flag is maintained at the L level, and a data transmission end interrupt is not generated. Therefore, competition for timing between the VCOM and image data output signals does not occur.

Figure 4:
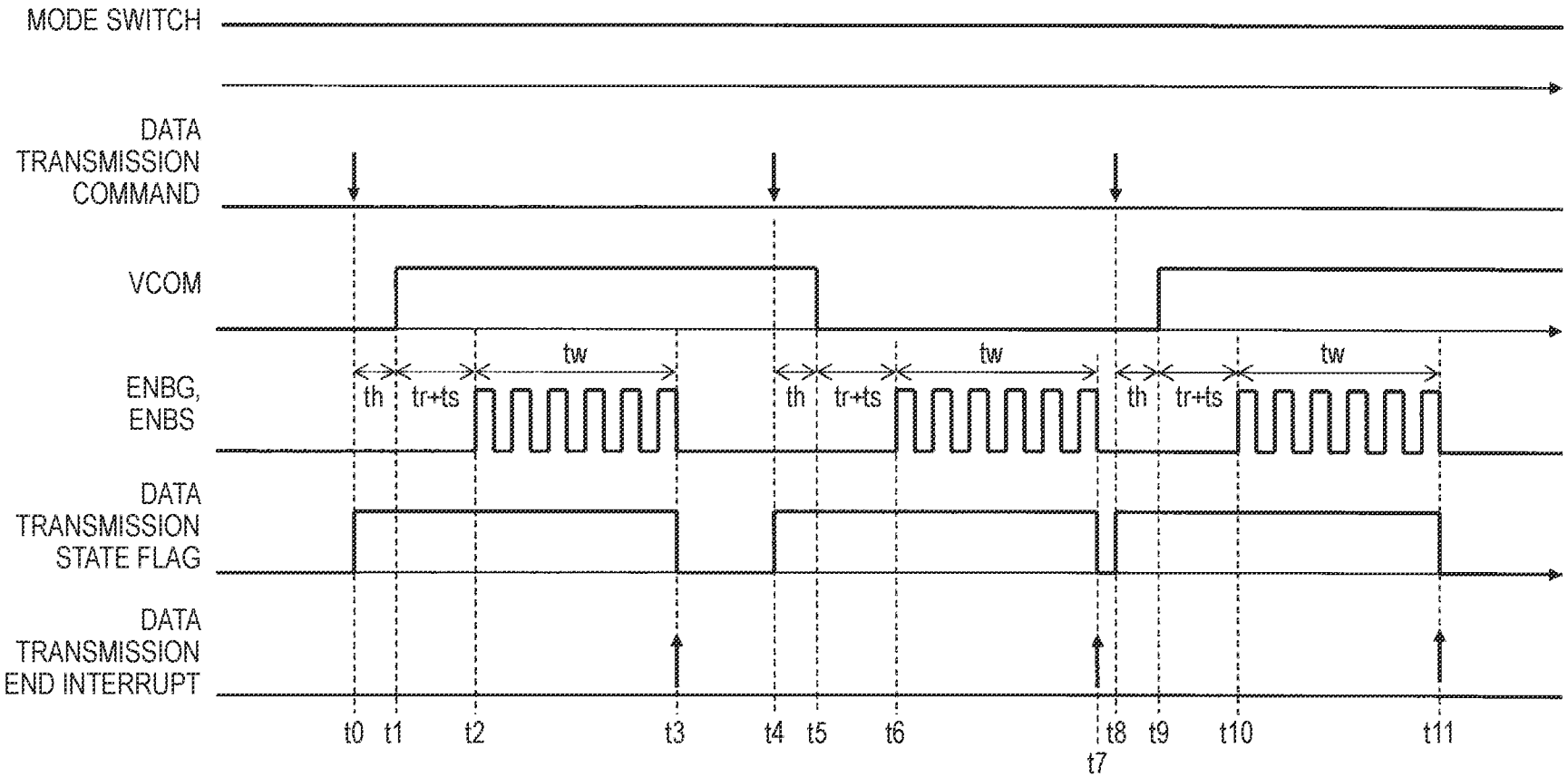
FIG. 4 is a time chart illustrating the case where VCOM inversion is performed at intervals of one frame in a VCOM synchronous-transmission mode.

FIG. 4 is a time chart illustrating the case where VCOM inversion is performed at intervals of one frame in a VCOM synchronous-transmission mode. Throughout the drawings, a period thVCOM is written simply as "th", and a period trVCOM is written simply as "tr", and an interval tcVCM is written simply as "tc".

In the VCOM synchronous-transmission mode, the VCOM is not inverted at the predetermined interval, but is inverted immediately before transmission of each data signal (i.e. at the timing earlier than the timing of transmission of each data signal by (trVCOM+tsVCOM). Therefore, the VCOM inversion timing and the data transmission timing are always different from each other. The period trVCOM is a transient period required to invert the polarity of the VCOM signal. The period tsVCOM is the period from an inversion of the polarity of the VCOM signal to when it becomes possible to perform data transmission.

In the example of FIG. 4, at a time point to, the CPU 2 outputs a data transmission command to the VCOM synchronous-transmission circuit 5. Then, the data transmission state flag changes from the L level to the H level. By this, the VCOM synchronous-transmission circuit 5 notifies the CPU 2 that the data transmission command has been received.

A time point t1 is the time point later than the time point t0 by the period thVCOM (a predetermined first period). At the time point t1, the VCOM changes from the L level to the H level. In this way, the polarity of the AC voltage of the MIP liquid crystal panel 6 is inverted.

A time point t2 is the time point later than the time point t1 by the period (trVCOM+tsVCOM) (a predetermined second period). At the time point t2, the enable signal becomes a pulse form. By this, the MIP liquid crystal panel 6 activates an image data signal. In other words, at the time point t2, the VCOM synchronous-transmission circuit 5 starts outputting the image data signal.

A time point t3 is the time point when a pulse of the enable signal ends, and is the time point later than the time point t2 by a period tw. At the time point t3, the data transmission state flag changes from the H level to the L level, and a data transmission end interrupt is generated. By this, the VCOM synchronous-transmission circuit notifies the CPU 2 that the next data transmission is possible.

By the series of operations from the time point t0 to the time point t3, a set of image data constituting an image frame is output to the MIP liquid crystal panel 6.

At a time point t4, the CPU 2 outputs a data transmission command to the VCOM synchronous-transmission circuit 5. Then, the data transmission state flag changes from the L level to the H level. By this, the VCOM synchronous-transmission circuit 5 notifies the CPU 2 that the data transmission command has been received.

A time point t5 is the time point later than the time point t4 by the period thVCOM. At the time point t5, the VCOM changes from the H level to the L level, i.e. the polarity is inverted.

A time point t6 is the time point later than the time point t5 by the period (trVCOM+tsVCOM). At the time point t6, the enable signal becomes a pulse form. By this, the MIP liquid crystal panel 6 activates an image data signal. In other words, at the time point t6, the VCOM synchronous-transmission circuit 5 starts outputting the image data signal.

A time point t7 is the time point when a pulse of the enable signal ends, and is the time point later than the time point t6 by the period tw. At the time point t7, the data transmission state flag changes from the H level to the L level, and a data transmission end interrupt is generated. By this, the VCOM synchronous-transmission circuit notifies the CPU 2 that the next data transmission is possible.

By the series of operations from the time point t4 to the time point t7, a set of image data constituting an image frame is output to the MIP liquid crystal panel 6.

The variations in the individual signals from a time point t8 to a time point t11 are the same as the variations in the individual signals from the time point t0 to the time point t3.

As described above, in the VCOM synchronous-transmission mode (the first mode), in synchronization with outputting of the enable signal, the polarity of the AC voltage to be applied to each display element is inverted. In this way, it is possible to avoid competition between the VCOM inversion signal and image data signals.

Figure 5:
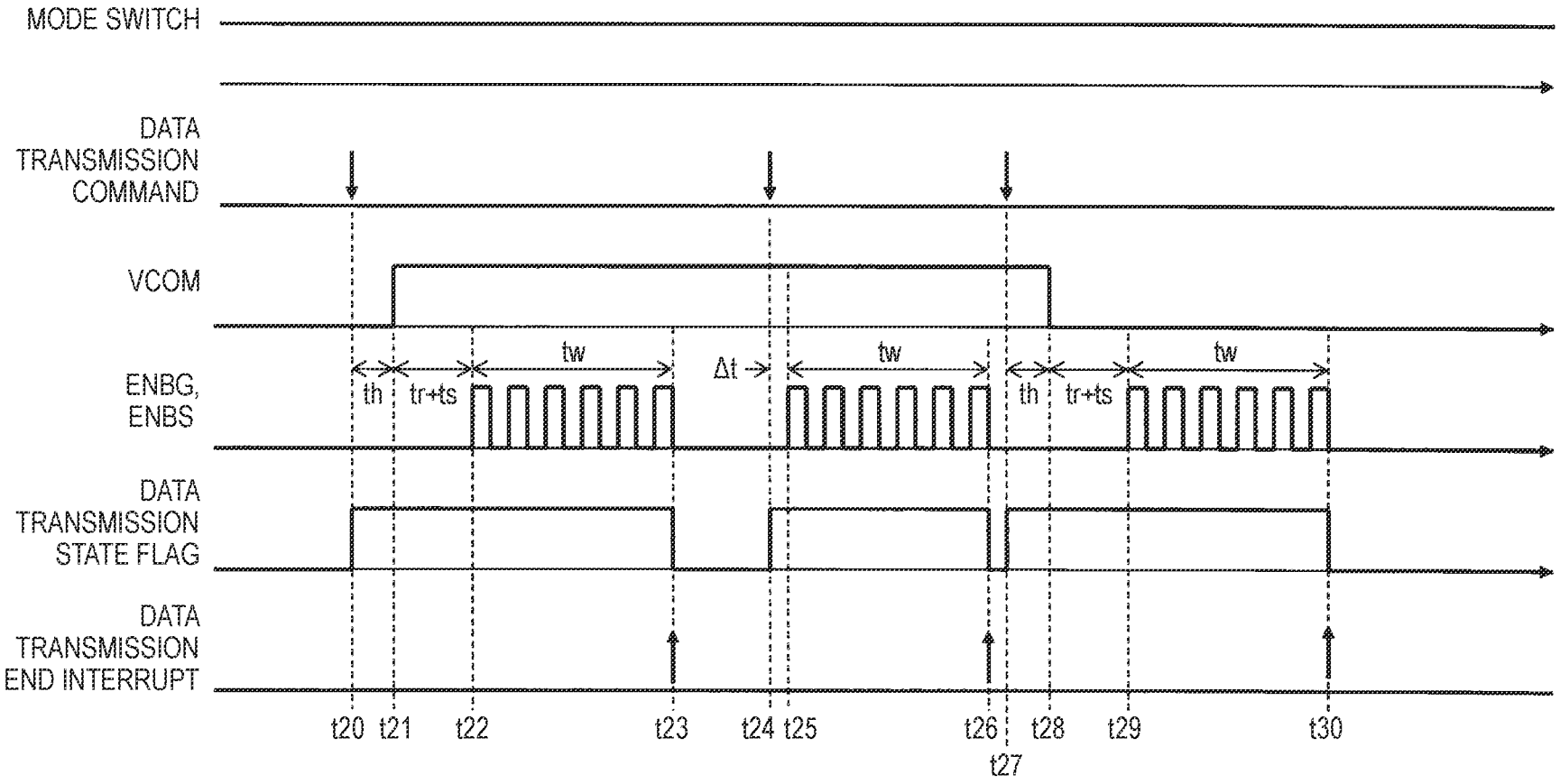
FIG. 5 is a time chart illustrating the case where VCOM inversion is performed at intervals of two frames in the VCOM synchronous-transmission mode.

FIG. 5 is a time chart illustrating the case where VCOM inversion is performed at intervals of two frames in the VCOM synchronous-transmission mode.

If the VCOM synchronous-transmission circuit inverts the VCOM and waits for the predetermined period whenever data transmission is performed, the frame rate of the MIP liquid crystal panel 6 may decrease. For this reason, the present embodiment is configured such that it is possible to set the number of times of VCOM inversion. For example, with respect to n-number of times of data transmission (wherein n is an integer of 2 or greater), the VCOM synchronous-transmission circuit inverts the VCOM and waits for the predetermined period. Inversion of the VCOM is performed only when the first data transmission is performed. In the time chart shown in FIG. 5, whenever data transmission is performed twice, the VCOM is inverted only once. In this way, it is possible to avoid competition between the VCOM inversion signal and drive signals while maintaining the frame rate.

In the example of FIG. 5, at a time point t20, the CPU 2 outputs a data transmission command to the VCOM synchronous-transmission circuit 5. Then, the data transmission state flag changes from the L level to the H level. By this, the VCOM synchronous-transmission circuit 5 notifies the CPU 2 that the data transmission command has been received.

A time point t21 is the time point later than the time point t20 by the period thVCOM. At the time point t21, the VCOM changes from the L level to the H level, i.e. the polarity is inverted.

A time point t22 is the time point later than the time point t21 by the period (trVCOM+tsVCOM). At the time point t22, the enable signal becomes a pulse form. By this, the MIP liquid crystal panel 6 activates an image data signal. In other words, at the time point t22, outputting of the image data signal is started.

A time point t23 is the time point when a pulse of the enable signal ends, and is the time point later than the time point t22 by the period tw. At the time point t23, the data transmission state flag changes from the H level to the L level, and a data transmission end interrupt is generated. By this, the VCOM synchronous-transmission circuit notifies the CPU 2 that the next data transmission is possible.

At a time point t24, the CPU 2 outputs a data transmission command to the VCOM synchronous-transmission circuit 5. Then, the data transmission state flag changes from the L level to the H level. By this, the VCOM synchronous-transmission circuit 5 notifies the CPU 2 that the data transmission command has been received.

A time point t25 is the time point later than the time point t24 by a period Δt. In the second data transmission operation, since the VCOM is not inverted, it is unnecessary to wait for the predetermined period. Therefore, immediately after a data transmission command, it is possible to perform the next data transmission. However, in practice, operations such as setting of a rewrite address of the MIP liquid crystal panel 6, acquisition and setting of image data, and so on are required from when a data transmission command is received to when a pulse of the enable signal rises. For this, the period Δt is required.

At the time point t25, the enable signal becomes a pulse form. By this, the MIP liquid crystal panel 6 activates an image data signal. In other words, at the time point t25, outputting of the image data signal is started.

A time point t26 is the time point when a pulse of the enable signal ends, and is the time point later than the time point t25 by the period tw. At the time point t26, the data transmission state flag changes from the H level to the L level, and a data transmission end interrupt is generated. By this, the VCOM synchronous-transmission circuit notifies the CPU 2 that the next data transmission is possible.

At a time point t27, the CPU 2 outputs a data transmission command to the VCOM synchronous-transmission circuit 5. Then, the data transmission state flag changes from the L level to the H level. By this, the VCOM synchronous-transmission circuit 5 notifies the CPU 2 that the data transmission command has been received.

A time point t28 is the time point later than the time point t27 by the period thVCOM. At the time point t28, the VCOM changes from the L level to the H level, i.e. the polarity is inverted.

A time point t29 is the time point later than the time point t28 by the period (trVCOM+tsVCOM). At the time point t29, the enable signal becomes a pulse form. By this, the MIP liquid crystal panel 6 activates an image data signal. In other words, at the time point t29, outputting of the image data signal is started.

A time point t30 is the time point when a pulse of the enable signal ends, and is the time point later than the time point t29 by the period tw. At the time point t30, the data transmission state flag changes from the H level to the L level, and a data transmission end interrupt is generated. By this, the VCOM synchronous-transmission circuit 5 notifies the CPU 2 that the next data transmission is possible.

By performing control as described above, the VCOM synchronous-transmission circuit 5 can avoid competition for transmission between the VCOM and data while maintaining the frame rate of the MIP liquid crystal panel 6.

Figure 6:
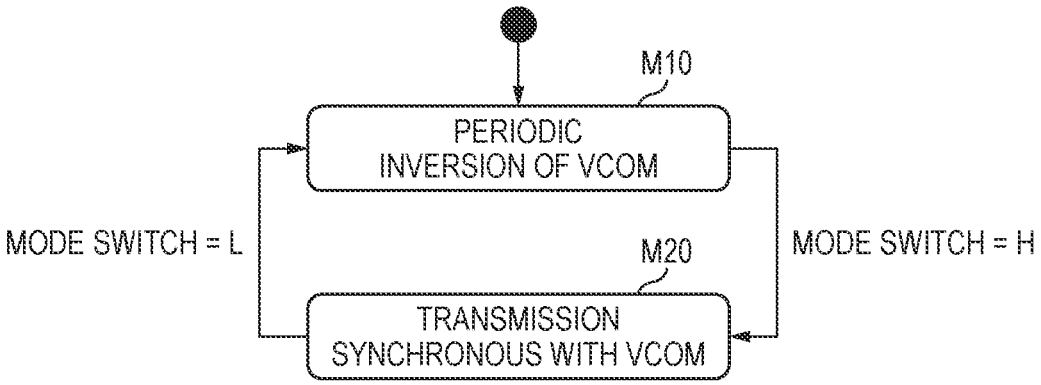
FIG. 6 is a view illustrating mode transition of the VCOM synchronous-transmission circuit.

FIG. 6 is a view illustrating mode transition of the VCOM synchronous-transmission circuit 5.

First, the VCOM synchronous-transmission circuit 5 starts the second mode (M10) in which the VCOM is periodically inverted. Processing in the mode M10 will be described below with reference to FIG. 7.

In the mode M10, if the mode switch signal changes to the H level, the VCOM synchronous-transmission circuit 5 transitions to the first mode (M20) in which data is transmitted in synchronization with the VCOM. Processing in the mode M20 will be described below with reference to FIG. 8.

In the mode M20, if the mode switch signal changes to the L level, the VCOM synchronous-transmission circuit 5 transitions to the second mode (M10) in which the VCOM is periodically inverted.

Figure 7:
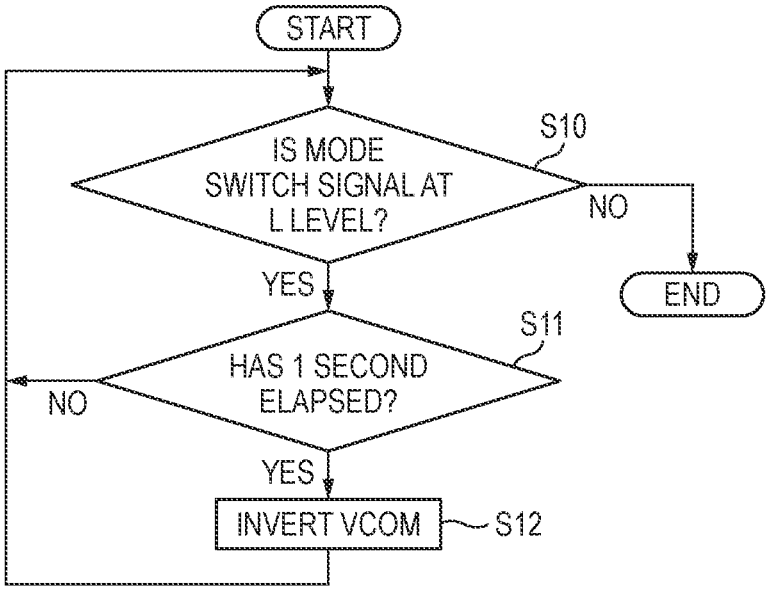
FIG. 7 is a flow chart in the periodic VCOM inversion mode.

FIG. 7 is a flow chart in the periodic VCOM inversion mode.

If starting processing, the VCOM synchronous-transmission circuit 5 determines whether the mode switch signal is at the L level (STEP S10). If the mode switch signal is not at the L level ("No" in STEP S10), the VCOM synchronous-transmission circuit 5 ends the processing of the FIG. 7, and transitions various processes shown in FIG. 8. If the mode switch signal is at the L level ("Yes" in STEP S10), the VCOM synchronous-transmission circuit 5 proceeds to STEP S11, and determines whether 1 second (the predetermined period) has elapsed (STEP S11).

If 1 second has elapsed ("Yes" in STEP S11), the VCOM synchronous-transmission circuit 5 inverts the VCOM (STEP S12), and returns to STEP S10. If 1 second has not elapsed ("No" in STEP S10), the VCOM synchronous-transmission circuit 5 returns to STEP S10.

Figure 8:
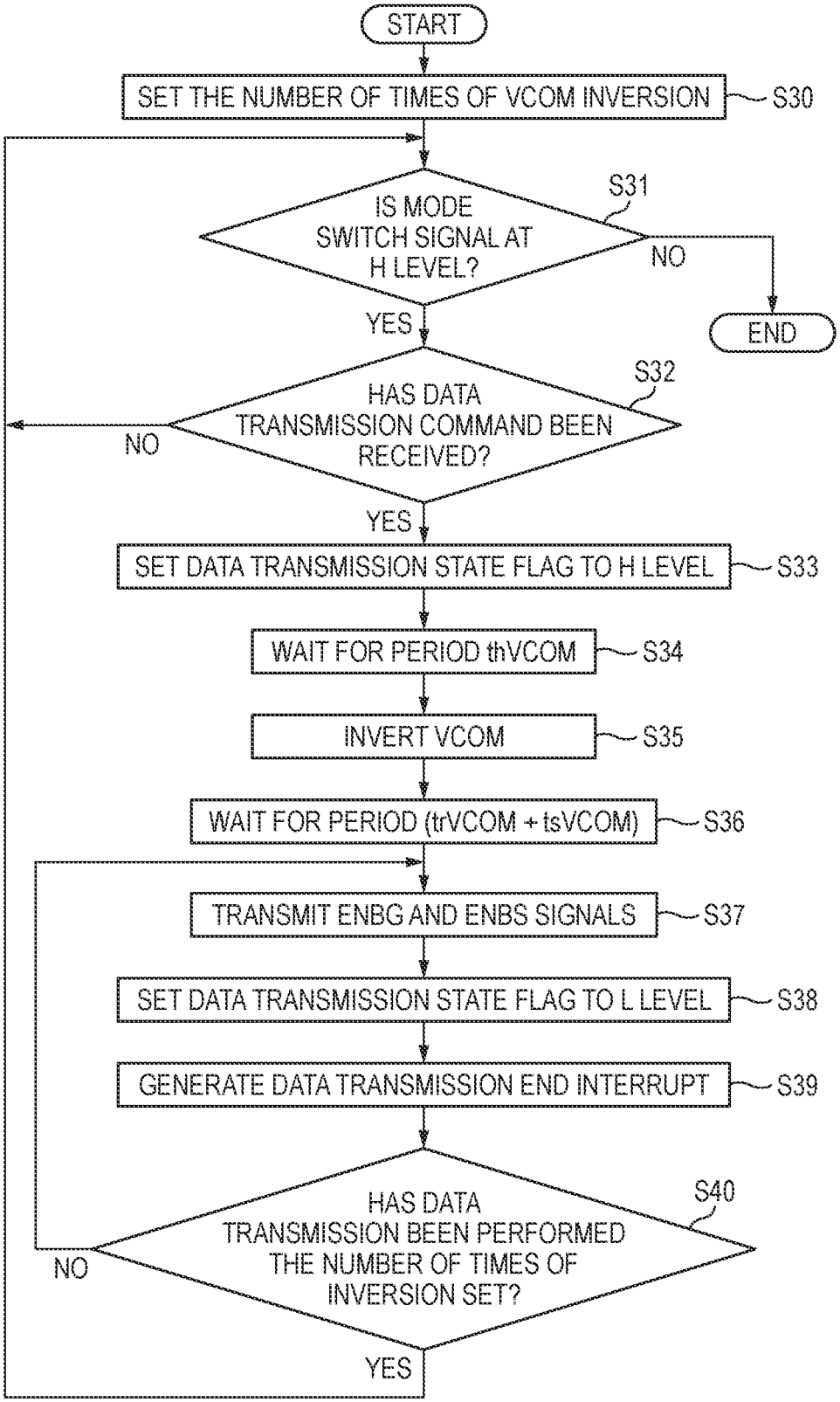
FIG. 8 is a flow chart in the VCOM synchronous-transmission mode.

FIG. 8 is a flow chart in the VCOM synchronous-transmission mode.

If transitioning to this mode, the VCOM synchronous-transmission circuit 5 sets the number of times of VCOM inversion (STEP S30). The number of times of VCOM inversion is set with respect to the VCOM synchronous-transmission circuit 5 by the CPU 2.

Next, the VCOM synchronous-transmission circuit 5 determines whether the mode switch signal is at the H level (STEP S31). If the mode switch signal is not at the H level ("No" in STEP S31), the VCOM synchronous-transmission circuit 5 ends the processing of FIG. 8, and transitions to the various processes shown in FIG. 7. If the mode switch signal is at the H level ("Yes" in STEP S31), the VCOM synchronous-transmission circuit 5 proceeds to STEP S32, and determines whether a data transmission command has been received.

If a data transmission command has not been received ("No" in STEP S32), the VCOM synchronous-transmission circuit 5 returns to the process of STEP S31. If a data transmission command has been received ("Yes"), the VCOM synchronous-transmission circuit 5 proceeds to the process of STEP S33, and sets the data transmission state flag to the H level. In this way, the CPU 2 can detect that a data transmission command has been received by the VCOM synchronous-transmission circuit 5.

Thereafter, the VCOM synchronous-transmission circuit 5 waits for the period thVCOM (STEP S34), and inverts the VCOM (STEP S35), and waits for the period (trVCOM+tsVCOM) (STEP S36). Then, the VCOM synchronous-transmission circuit 5 transmits the enable signals (ENBG and ENBS) (STEP S37). The VCOM synchronous-transmission circuit 5 sets the data transmission state flag at the L level (STEP S38), and generates an data transmission end interrupt (STEP S39) to notify the end timing of the data transmission operation to the CPU 2.

In STEP S40, the VCOM synchronous-transmission circuit 5 determines whether image data constituting image frames has been transmitted the number of times of inversion set. If image data constituting image frames has been transmitted the number of times of inversion set ("Yes"), the VCOM synchronous-transmission circuit 5 returns to the process of STEP S31. If image data constituting image frames has not been transmitted the number of times of inversion set ("No"), the VCOM synchronous-transmission circuit 5 returns to the process of STEP S37.

MODIFICATIONS

The above-described embodiment can be modified, for example, in the following forms (a) to (c). (a) The VCOM synchronous-transmission circuit 5 is installed in the electronic device 1; however, it can be installed in other electronic devices. For example, the VCOM synchronous-transmission circuit can be installed in e-book readers, tablets, heart rate monitors, pedometers, thermometers, stopwatches, and so on.

(b) The period thVCOM from when the VCOM synchronous-transmission circuit 5 receives a data transmission command to when the VCOM synchronous-transmission circuit inverts the VCOM is not limited to a minimum period required to avoid competition between the VCOM inversion signal and data signals, and may be set to have a length equal to that of the minimum period or longer than that of the minimum period by 500 msec (milisecond) or less. 500 msec is half of the inversion interval in the mode in which the VCOM is periodically inverted.

(c) The period (trVCOM+tsVCOM) from when the VCOM synchronous-transmission circuit 5 inverts the VCOM to when the VCOM synchronous-transmission circuit transmits data is not limited to a minimum period required to avoid competition between the VCOM inversion signal and data signals, and may be set to have a length equal to that of the minimum period or longer than that of the minimum period by 500 msec or less. 500 msec is half of the inversion interval in the mode in which the VCOM is periodically inverted.

What is claimed is:

1. A liquid crystal control circuit for driving a MIP liquid crystal panel, wherein the MIP liquid crystal panel has a plurality of pixels, each of which including a memory element and a display element, the memory element holds electric potential depending on an image signal, the display element is applied voltage depending on the electric potential which the memory element holds, and the liquid crystal control circuit comprises:

a VCOM inversion circuit, which, in a first mode, inverts polarity of VCOM voltage applied to the display element after a first period of elapsed time from when the MIP liquid crystal panel receives a data transmission command, wherein VCOM inversion is performed at intervals of n frames, where n is an integer of 2 or greater, and an enable circuit, which, in the first mode, outputs an enable signal to the MIP liquid crystal panel after a second period of elapsed time from when the polarity of the VCOM voltage is inverted, the enable signal activating the image signal output to the MIP liquid crystal panel.

2. The liquid crystal control circuit according to claim 1, wherein the polarity of the VCOM voltage applied to the display element is inverted at a predetermined interval, in a second mode in which the enable signal is not output to the MIP liquid crystal panel.

3. The liquid crystal control circuit according to claim 2, wherein the first period of elapsed time is at most one half of the predetermined interval at which the polarity of the VCOM voltage is inverted in the second mode.

4. The liquid crystal control circuit according to claim 1, wherein the enable circuit, in the first mode, outputs the enable signal a defined number of times before the polarity of the VCOM voltage is inverted again.

5. The liquid crystal control circuit according to claim 1, which, in operation, couples to the MIP liquid crystal panel to form an electronic timepiece.

6. The liquid crystal control circuit according to claim 1, wherein the second period of elapsed time is a sum of a transient period required to invert the polarity of the VCOM voltage and a period from the inversion of the polarity of the VCOM voltage to a start of data transmission.

7. The liquid crystal control circuit according to claim 1, which, in operation, couples to the MIP liquid crystal panel to form an electronic device selected from an e-book reader, a tablet, a heart rate monitor, a pedometer, a thermometer, and a stopwatch.

8. A liquid crystal control method for driving a MIP liquid crystal panel, wherein the MIP liquid crystal panel has a plurality of pixels, each of which including a memory element and a display element, the memory element holds electric potential depending on an image signal, the display element is applied voltage depending on the electric potential which the memory element holds, and the liquid crystal control method comprises:

in a first mode, inverting polarity of VCOM voltage applied to the display element after a first period of elapsed time from when the MIP liquid crystal panel receives a data transmission command, wherein VCOM inversion is performed at intervals of n frames, where n is an integer of 2 or greater, and in the first mode, outputting an enable signal to the MIP liquid crystal panel after a second period of elapsed time from when the polarity of the VCOM voltage is inverted, the enable signal activating the image signal output to the MIP liquid crystal panel.

9. The liquid crystal control method according to claim 8, comprising:

inverting the polarity of the VCOM voltage applied to the display element at a predetermined interval, in a second mode in which the enable signal is not output to the MIP liquid crystal panel.

10. The liquid crystal control method according to claim 9, wherein the first period of elapsed time is at most one half of the predetermined interval at which the polarity of the VCOM voltage is inverted in the second mode.

11. The liquid crystal control method according to claim 8, wherein the second period of elapsed time is a sum of a transient period required to invert the polarity of the VCOM voltage and a period from the inversion of the polarity of the VCOM voltage to a start of data transmission.

12. The liquid crystal control method according to claim 8, comprising:

in the first mode, outputting the enable signal a defined number of times before the polarity of the VCOM voltage is inverted again.

* * * * *